United States Patent [19]

Sundström

[11] Patent Number: 5,052,385

[45] Date of Patent: Oct. 1, 1991

[54] FILTER CONTAINER FOR AN ABSORPTION FILTER AND A PARTICLE FILTER, FOR DIRECT OR INDIRECT CONNECTION TO A PROTECTIVE MASK

[75] Inventor: Per O. Sundström, Lidingö , Sweden

[73] Assignee: Sundström Safety AB, Lidingö , Sweden

[21] Appl. No.: 113,118

[22] Filed: Oct. 27, 1987

[30] Foreign Application Priority Data

Oct. 30, 1986 [SE] Sweden ..... 8604641

[51] Int. Cl.[5] ..... A62B 7/10

[52] U.S. Cl. ..... 128/205.27; 128/205.28; 128/205.29

[58] Field of Search ..... 128/205.27, 205.28, 128/205.29, 206.12

[56] References Cited

U.S. PATENT DOCUMENTS

| | | | |
|---|---|---|---|
| 3,118,445 | 1/1964 | Norman | 128/141 |
| 4,543,112 | 9/1985 | Ackley et al. | 128/205.27 |
| 4,548,626 | 10/1985 | Ackley et al. | 128/201.25 |
| 4,714,486 | 12/1987 | Silverthorn | 128/205.28 |

FOREIGN PATENT DOCUMENTS

| | | |
|---|---|---|
| 3515642 | 10/1985 | Fed. Rep. of Germany . |
| 1464075 | 12/1966 | France . |
| 2121282 | 8/1972 | France . |

*Primary Examiner*—Lee S. Cohen
*Assistant Examiner*—J. P. Lacyk
*Attorney, Agent, or Firm*—Shapiro and Shapiro

[57] ABSTRACT

The invention concerns a filter container for an absorption filter (8) and a particle filter (7); the container being adapted to be connected to a protective mask. The filter container is characterized in that it comprises a cup-shaped casing (1) which has in its bottom (2) an intake (3) for inhalation air, and a cover (4) closing the casing (1), the cover having an outtake (5) for inhalation air and being connectible to the protective mask, the particle filter (7) being arranged at the bottom (2) of the cup-shaped casing (1), and the absorption filter (8) being arranged between the particle filter and the cover (4) closing the casing; that the particle filter (7) is sealed to the casing (1) by glue (9) applied to the inner side of the casing; that the portion (14) of the cup-shaped casing (1) containing the particle filter (7) is essentially cylindrical and has a diameter smaller than the remaining cylindrical casing portion (13) containing the absorption filter; that the bottom (2) of the casing (1) and the cover (4) are slightly conically bulging outwardly towards the air intake (3) and the air outtake (5), respectively; and that closely lying, radially extending stiffening ribs (15, 16) are arranged on the slightly conical portions of the bottom (2) and the cover (4), respectively, and have their tops (17) facing inwardly towards the container lying in radial planes.

13 Claims, 3 Drawing Sheets

Fig.1
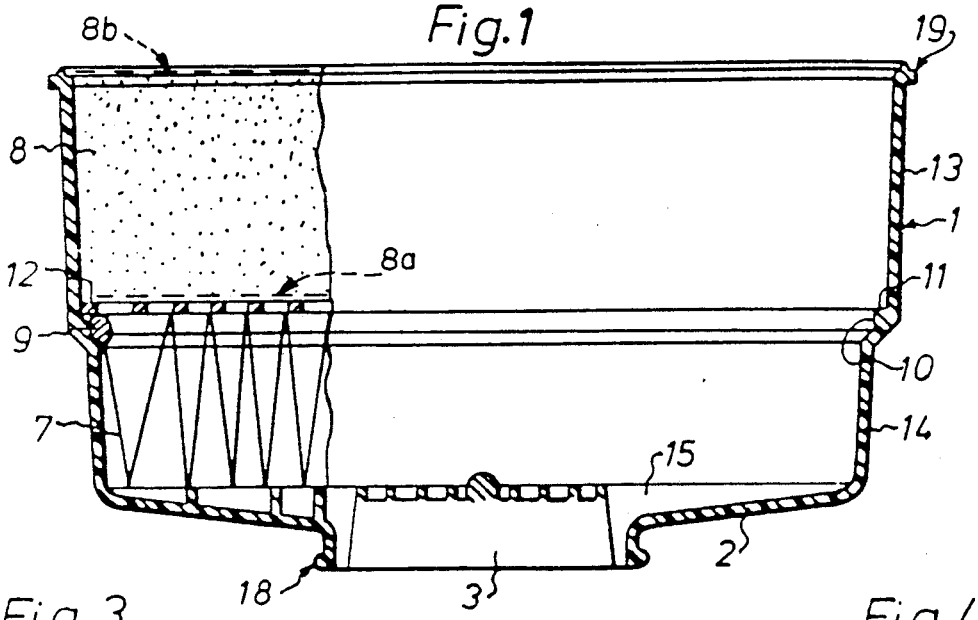
Fig.3
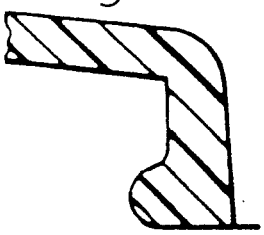
Fig.4
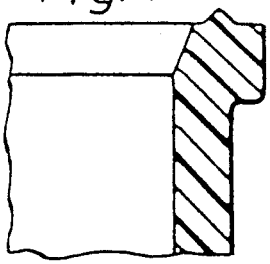
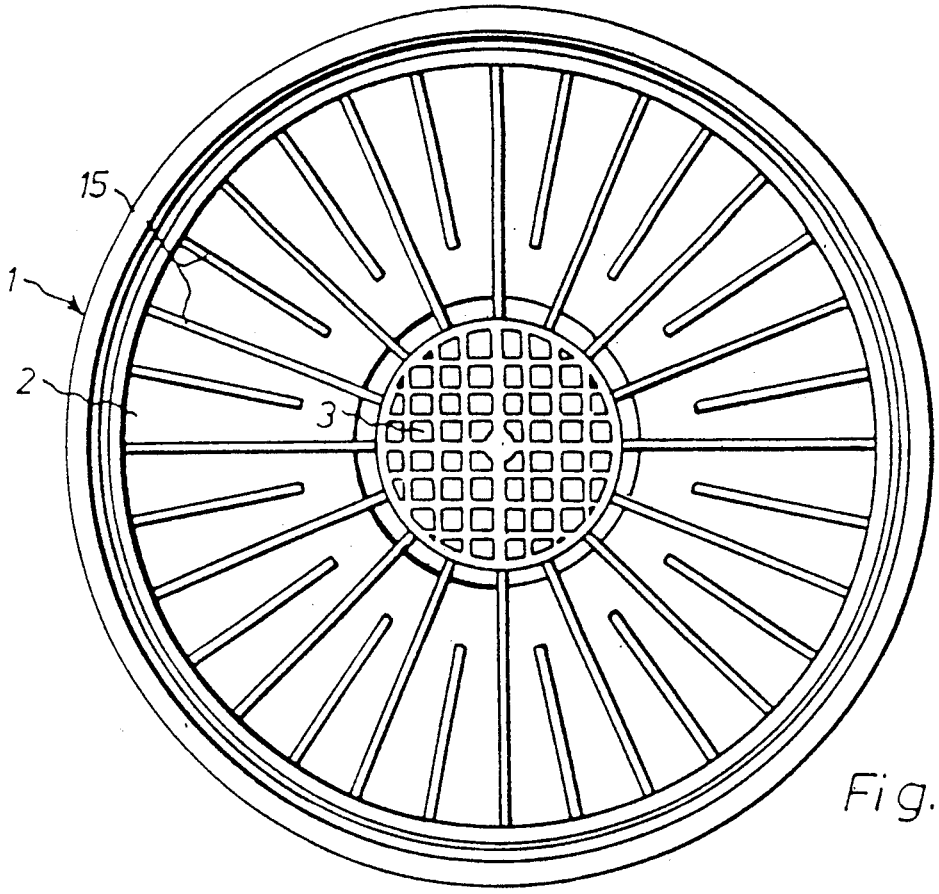
Fig.2

Fig. 9
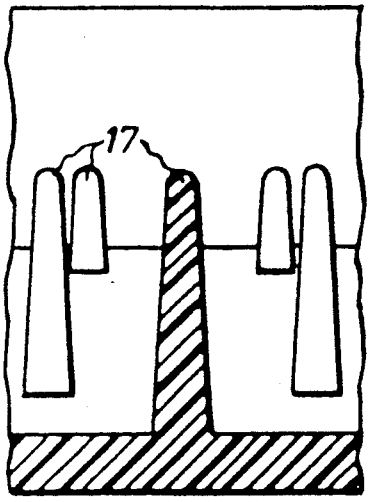
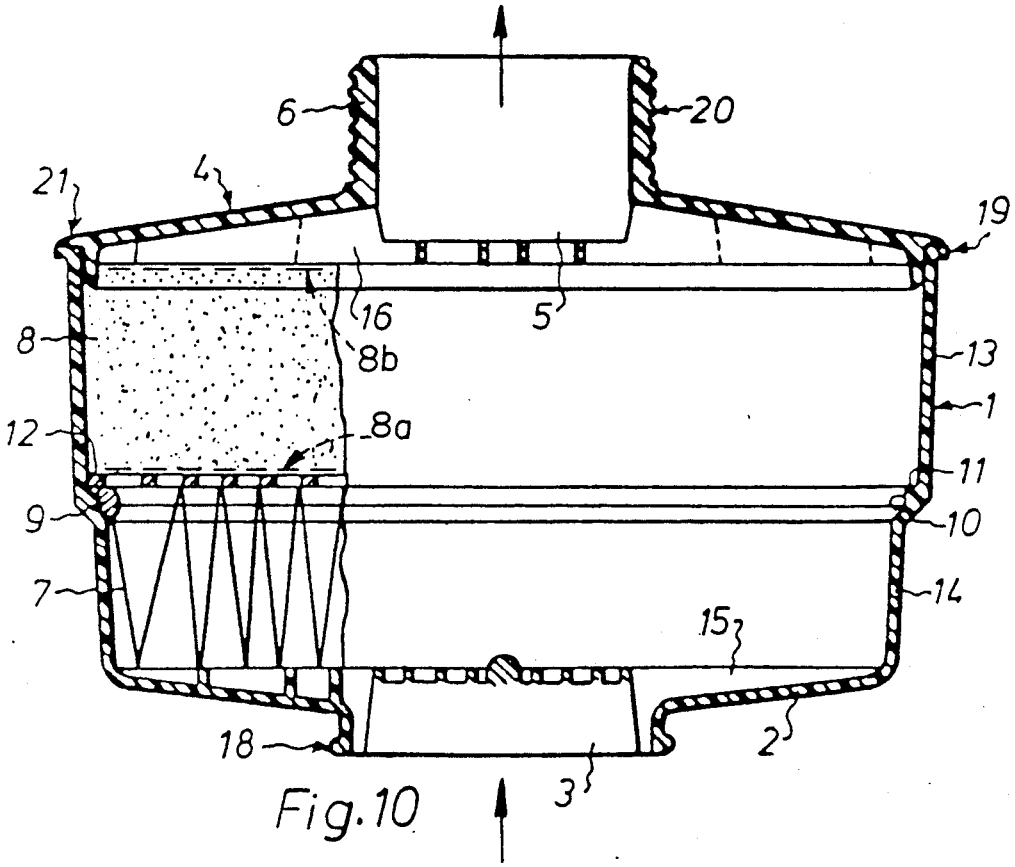
Fig. 10

FILTER CONTAINER FOR AN ABSORPTION FILTER AND A PARTICLE FILTER, FOR DIRECT OR INDIRECT CONNECTION TO A PROTECTIVE MASK

SUMMARY OF THE INVENTION

The present invention relates to a filter container for an absorption filter and a particle filter, said container being adapted to be directly or indirectly connected to a protective mask. The filter container is characterized in that it comprises a cup-shaped casing which has in its bottom an intake for inhalation air, and a cover closing said casing, said cover having an outtake for inhalation air and being connectible to the protective mask, said particle filter being arranged at the bottom of the cup-shaped casing, and said absorption filter being arranged between the particle filter and the cover closing the casing; that the particle filter is sealed to the casing by means of glue applied to the inner side of the casing; that the portion of the cup-shaped casing containing the particle filter is essentially cylindrical and has a diameter smaller than the remaining cylindrical casing portion containing the absorption filter; that the bottom of the casing and the cover are slightly conically bulging outwardly towards the air intake and the air outtake, respectively; and that closely lying, radially extending stiffening ribs are arranged on the slightly conical portions of the bottom and the cover, respectively, and have their tops facing inwardly towards the container lying in radial planes.

One of the advantages afforded by the present invention is that the tightness of the particle filter can be tested during production, before the casing is equipped with the absorption filter, whereby the production cost can be kept low.

The invention will be described in more detail below, reference being had to the accompanying drawings which illustrate an embodiment, chosen by way of example, of the filter container according to the invention.

BRIEF DESCRIPTION OF THE DRAWINGS

FIG. 1 is a vertical section of the casing, the left hand side showing the two filters;

FIG. 2 shows the casing as seen from above;

FIGS. 3 and 4 show parts of FIG. 1 on a far larger scale;

FIG. 9 shows, on a far larger scale, a section of FIG. 6 along the arrows indicated therein; and FIG. 10 shows the components according to FIGS. 1 and 5 in the assembled state, partly in section.

DETAILED DESCRIPTION OF THE PREFERRED EMBODIMENT

Figure 5:
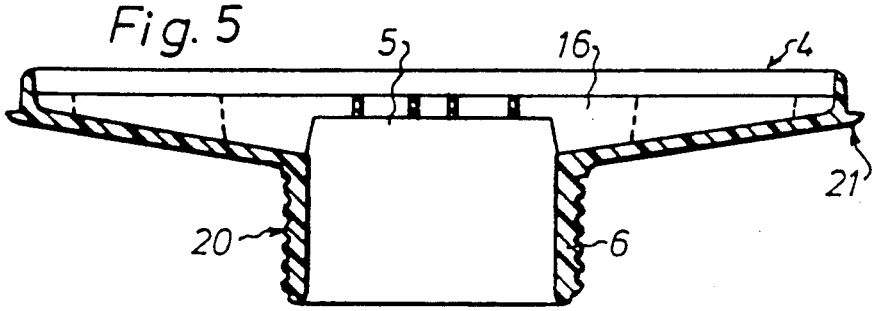
FIG. 5 is a vertical section of the cover.

The filter container comprises the cup-shaped casing 1, the bottom 2 of which is formed with an air intake 3, and a cover 4 closing the casing 1 and formed with an air outtake 5. The cover 4 is adapted to be directly or indirectly connected to a protective mask. To this end, the cover 4 either has a tubular, threaded central portion 6 for direct connection with the protective mask, or is formed such that it can be connected to the mask via an adapter.

As will appear from FIG. 1, the particle filter 7 is provided at the bottom 2 of the cup-shaped casing 1, the absorption filter 8 being mounted above the particle filter 7 in the casing. In the embodiment illustrated, the particle filter 7 consists of a folded paper-like material, while the absorption filter 8 may be a carbon filter.

Figure 7:
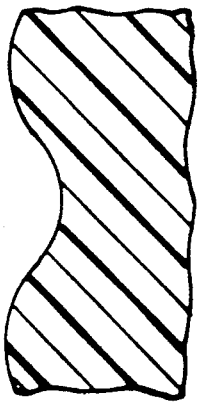
FIGS. 7 and 8 show parts of FIG. 5 on a far larger scale.
Figure 8:
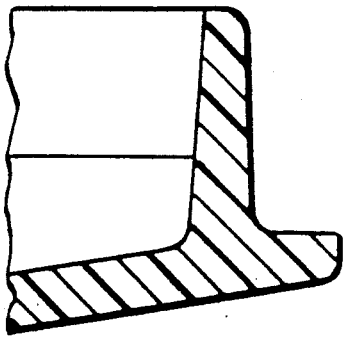

The particle filter preferably having thin textile filters 8*a*, 8*b* mounted on both sides thereof as indicated diagrammatically in FIGS. 1 and 10, 7 is tightly connected to the casing 1 by applying a glue 9 around the inner side of the casing. The glue 9 is applied to the upper edge of the particle filter 7, where the casing 1 has an annular recess 10 to accommodate the glue 9.

Figure 6:
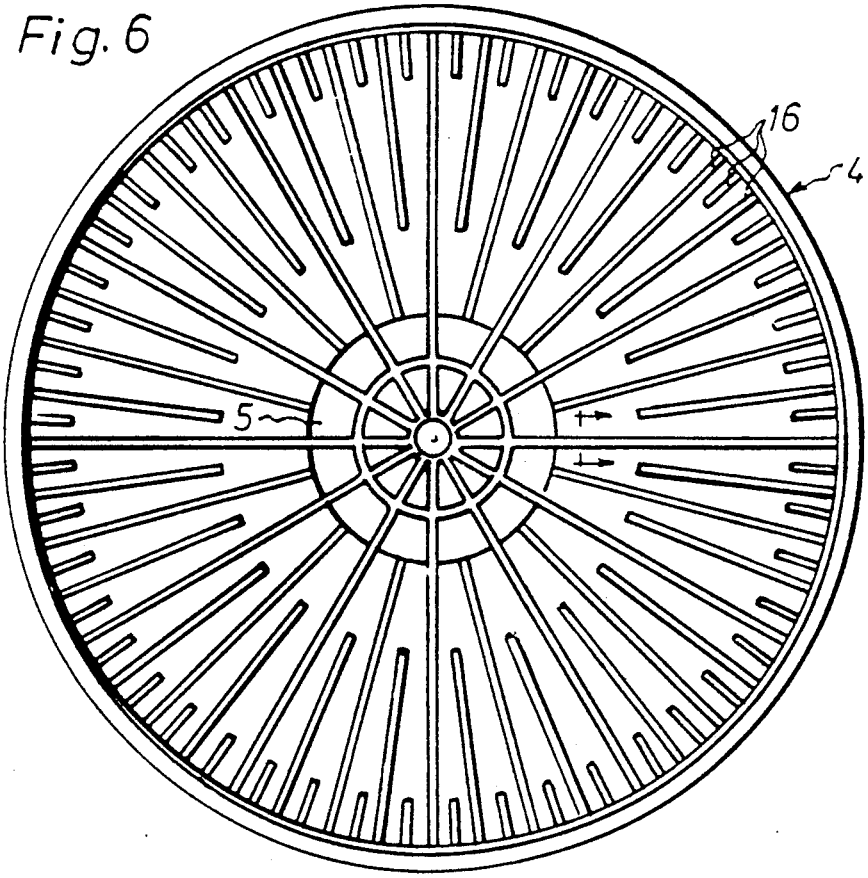
FIG. 6 shows the cover as seen from below.

About the air intake 3 in the bottom 2 of the casing 1 and about the air outtake 5 in the cover 4, large numbers of radially extending stiffening ribs 15, 16 are closely arranged at small acute angles (in the form shown, 32 ribs at angles of about 11° on bottom 2 and 96 ribs at angles of about 4° on cover 4). As will appear from the drawings, the bottom 2 of the casing 1 and the cover 4 are slightly conically bulging outwardly towards the air intake 3 and the air outtake 5, respectively, the tops 17 of each set of stiffening ribs 15, 16, which are facing inwardly toward the container, lying substantially in a single plane, as seen, for example, in FIG. 9. Preferably, as shown in FIGS. 2 and 6, ribs 15 and 16 are arranged with alternate longer and shorter radial lengths extending from points substantially uniformly distant from the filter container axis. Also, as showing FIGS. 1 and 10, particle filter 7 may be positioned by engagement with grid 12 and longitudinal edges of ribs 15 at the top folds and bottom folds of the filter 7, respectively.

Above the annular recess 10, the casing 1 has an annular shoulder 11 against which a grid 12 defining the absorption filter 8 is adapted to abut. The absorption filter 8 is adapted, in the closed condition of the casing 1, to urge the grid 12 into firm engagement with the annular shoulder 11. As will be appreciated from FIGS. 5 and 10, ribs 16 of cover 4 are dimensioned to project sufficiently inwardly of the cover, when it has been applied to casing 1, such that the tops 17 of the ribs are received in the casing. As the ribs 16 enter the casing in the illustrative embodiment, they thus come into direct contact with upper textile filter 8*b* (initially positioned as shown in FIG. 1), and thereby press against the powder material of absorption filter 8. When the cover 4 has been applied to the casing 1 (see FIG. 10), it thus compresses the powder material of the absorption filter 8, whereupon it is connected with the casing 1 by welding or the like.

The casing 1 and the cover 4 preferably are made from thermosetting plastic, the thickness of the plastic material being maintained essentially constant. This means that the casing part 13 containing the absorption filter 8 is wider than the casing part 14 containing the particle filter 7, because of the offset provided by the recess 10 and the shoulder 11. Since the cylindrical portion 14 thus has a diameter which is smaller than that of the portion 13, the assembled filter container will not to any appreciable degree block the field of vision of the person wearing the protective mask.

In FIGS. 3, 4, 7 and 8, the components 18, 19, 20 and 21 as illustrated in FIGS. 1 and 5 are shown on a larger scale.

The invention is not restricted to the embodiment described above and illustrated in the drawings, but may be modified in various ways within the scope of the appended claims.

I claim:

1. A filter container for direct or indirect connection to a protective mask, comprising a cup-shaped casing having a bottom wall bulging slightly outwardly toward an inhalation air intake form in said bottom wall, a cover closing said casing and having a top wall bulging slightly outwardly toward an inhalation air outtake formed in said top wall, a particle filter disposed within a bottom portion of said casing and adhesively sealed around its circumference to an inner sidewall of said casing, and an absorption filter mounted between said particle filter and said cover within an upper portion of said casing, said bottom wall having a large number of inwardly projecting, closely spaced, radially directed stiffening ribs formed thereon at small acute-angle intervals about its circumference, said stiffening ribs having inwardly facing longitudinal edges lying substantially in a single plane, and wherein said particle filter has upper and lower folds and said particle filter engages at lower folds thereof the inwardly facing longitudinal edges of at least some of said stiffening ribs and engages at upper folds thereof a member supporting a bottom of said absorption filter.

2. A filter container for direct or indirect connection to a protective mask, comprising a cup-shaped casing having a bottom wall bulging slightly outwardly toward an inhalation air intake formed in said bottom wall, a cover closing said casing and having a top wall bulging slightly outwardly toward an inhalation air outtake formed in said top wall, a particle filter disposed within a bottom portion of said casing and adhesively sealed around its circumference to an inner sidewall of said casing, and an absorption filter mounted between said particle filter and said cover within an upper portion of said casing said absorption filter having thin textile filters mounted on upper and lower sides thereof, said top wall having a large number of inwardly projecting, closely spaced, radially directed stiffening ribs formed thereof at small acute-angle intervals about its circumference, with said ribs being in compressive direct contact with the textile filter mounted on said upper side of said absorption filter.

3. A filter container according to claim 2, wherein said ribs are arranged alternately in longer and shorter radial lengths.

4. A filter container according to claim 3, wherein said ribs have respective radial outer ends substantially uniformly distant from an axis of the filter container.

5. A filter container according to claim 2, wherein said ribs have inwardly facing longitudinal edges lying substantially in a single plane.

6. A filter container according to claim 2, wherein said bottom wall also has a large number of inwardly projecting, closely spaced, radially directed stiffening ribs formed thereon at small acute-angle intervals about its circumference, said ribs of said bottom wall have inwardly facing longitudinal edges lying substantially in a single plane, said particle filter has upper and lower folds, and said particle filter engages at lower folds thereof the inwardly facing longitudinal edges of at least some of said ribs of said bottom wall and engages at upper folds thereof a member supporting a bottom of said absorption filter.

7. A filter container for direct or indirect connection to a protective mask, comprising a cup-shaped casing having a bottom wall bulging slightly outwardly toward an inhalation air intake formed in said bottom wall, a cover closing said casing and having a top wall bulging slightly outwardly toward an inhalation air outtake formed in said top wall, a particle filter disposed within a bottom portion of said casing and adhesively sealed around its circumference to an inner sidewall of said casing, and an absorption filter mounted between said particle filter and said cover within an upper portion of said casing, said absorption filter having thin textile filters mounted on upper and lower sides thereof, and wherein each of said bottom wall and said top wall has a large number of inwardly projecting, closely spaced, radially directed stiffening ribs formed thereon at small acute-angle intervals about its circumference, and the stiffening ribs are circumferentially arranged alternately in longer and shorter radial lengths on said bottom wall and said top wall.

8. A filter container according to claim 7, wherein the stiffening ribs have respective radial outer ends substantially uniformly distant from an axis of the filter container.

9. A filter container for direct or indirect connection to a protective mask, comprising a cup-shaped casing having a bottom wall bulging slightly outwardly toward an inhalation air intake formed in said bottom wall, a cover closing said casing and having a top wall bulging slightly outwardly toward an inhalation air outtake formed in said top wall, a particle filter disposed within a bottom portion of said casing and adhesively sealed around its circumference to an inner sidewall of said casing, and an absorption filter mounted between said particle filer and said cover within an upper portion of said casing, said absorption filter having thin textile filters mounted on upper and lower sides thereof, each of said bottom wall and said top wall having a large number of inwardly projecting, closely spaced, radially directed stiffening ribs formed thereon at small acute-angle intervals about its circumference, with the respective stiffening ribs of each of said bottom wall and said top wall having inwardly facing longitudinal edges lying substantially in a corresponding single plane, and wherein said particle filter has upper and lower folds and said particle filter engages at lower folds thereof the inwardly facing longitudinal edges of stiffening ribs of said bottom wall and engages at upper folds thereof a member supporting a bottom of said absorption filter.

10. A filter container according to claim 9, wherein the upper portion of said casing has a circumferential shoulder on which said absorption filter is mounted and said lower portion of said casing has a circumferential recess adjacent to said circumferential shoulder and to which an upper circumferential edge of said particle filter is glued.

11. A filter container according to claim 10, wherein said member defining the bottom of said absorption filter is urged firmly against said shoulder by said absorption filter.

12. A filter container according to claim 7, wherein said lower portion of said casing has a cylindrical sidewall and said upper portion of said casing has a cylindrical sidewall of slightly greater diameter than said sidewall of said lower portion.

13. A filter container according to claim 7, wherein said cover is bonded to said casing and said inhalation air outtake has a threaded tubular extension for connection to the protective mask.

* * * * *